United States Patent [19]

Baermann

[11] 4,190,548

[45] Feb. 26, 1980

[54] PLASTIC BONDED PERMANENT MAGNET AND METHOD OF MAKING SAME

[76] Inventor: Max Baermann, Postfach 26, 5060 Bergisch Gladbach 1, Fed. Rep. of Germany

[21] Appl. No.: 925,966

[22] Filed: Jul. 19, 1978

[30] Foreign Application Priority Data

Aug. 13, 1977 [DE] Fed. Rep. of Germany ..... 2736642

[51] Int. Cl.[2] ..... H01F 1/06

[52] U.S. Cl. ..... 252/62.54; 335/303

[58] Field of Search ..... 252/62.54, 62.53; 335/303

[56] References Cited

U.S. PATENT DOCUMENTS

| | | | |
|---|---|---|---|
| 2,238,893 | 4/1941 | Fischer | 252/62.54 |
| 2,849,312 | 8/1958 | Peterman | 252/62.53 |
| 3,152,082 | 10/1964 | Davis et al. | 252/62.54 |
| 3,998,669 | 12/1976 | Strnat | 148/31.57 |
| 4,076,861 | 2/1978 | Furukawa et al. | 427/132 |

*Primary Examiner*—F. C. Edmundson

*Attorney, Agent, or Firm*—Meyer, Tilberry & Body

[57] ABSTRACT

A plastic bonded permanent magnet including particles of permanent magnet material having a high affinity for oxygen, such as ultra-fine grain iron, bismuth-manganese and cobalt rare earth magnetic materials, dispersed within a substantially oxygen free plastic.

9 Claims, No Drawings

PLASTIC BONDED PERMANENT MAGNET AND METHOD OF MAKING SAME

This invention relates to the art of plastic bonded permanent magnet material and the method of making same.

BACKGROUND OF THE INVENTION

In the manufacture of permanent magnet materials, sintering and casting processes have been known for a long time. In recent years it has become common practice to mix powdered magnetic materials with a plastic binder to form a mixture which is formed into the desired shape by pressing, injection molding and extruding and rolling, with or without a magnetic directional field for aligning the particles when they are anisotropic. It has also been suggested to use metals with an appropriate melting point as the binder instead of plastic material.

The use of duroplastic and thermoplastic synthetic materials as the plastic binder can cause difficulties, particularly if the permanent magnet material forming the particles of the bonded magnet have a great affinity for oxygen. For instance, finely powdered iron, bismuth-manganese, SE-magnets and cobalt, rare-earth magnetic powder material have high affinity for oxygen and their effectiveness can be reduced by oxidation. Binding these materials with plastic offers substantial technological advantages; however, the plastic binder and the normal procedure for processing plastic bonded magnets has not been generally successful, from a commercial standpoint because it was not economical or practical to prevent undue oxidation of the particles. One has, therefore, essentially restricted the production of plastic bonded permanent magnetic molded bodies to mixtures using permanent magnet materials which are resistant to oxidation. In the processing of permanent magnet materials with great affinity for oxygen, corrosion cannot be prevented with certainty with the customary plastic binding agents or normal methods of making bonded magnets. There are, however, situations in which the application of such oxygen affinitive materials would offer particular advantages.

The Invention

The invention relates to a process of making a plastic bonded permanent magnet material using particles which have a high affinity for oxygen, either because of their small size, composition or both.

Tests have shown that plastic bonded magnets can be made of permanent magnet materials with a high oxygen affinity. This is possible if the binding agent for the molded bodies is a plastic which does not contain any oxygen. In other words, the plastic is oxygen free. Beyond this, it has been found advantageous not to mix the oxygen free plastic material and the high oxygen affinity permanent magnet material with each other in the form of a powder, as is customary in the normal production of plastic bonded magnets. It is advantageous to form the oxygen free plastic into a liquid or solution by mixing with a solvent, likewise containing no oxygen. Then the liquid or solution is subsequently mixed with the permanent magnet powder. This prevents entrapment of any ambient oxygen. Also, the process can use a surrounding atmosphere of an inert gas to exclude any ambient oxygen during mixing of the powder of high oxygen affinity particles with the plastic solution or liquid.

If an anisotropic permanent magnet material is used in the process of the invention, the mixture may be magnetized immediately after the mixing operation. From this mixture of magnet powder and plastic solution the solvent is evaporated as the mixture is stirred. This stirring and evaporation can be done with an inert atmosphere protecting the material from ingress of oxygen. As the solvent evaporates, the solution becomes more viscous and then takes the consistency of the plastic. This produces a granulated substance which is oxygen free plastic around the particles.

The granulated material may be used in a known manner by casting or injection molding into molded magnetic bodies. In the molding process to give the final shape to the magnet, a magnetic directional field is often applied. Whenever particularly high magnetic demands are made on the molded body, the injection-molded body can be compressed to remove excess plastic by pressing the magnet again in a mold under appropriate heating conditions.

The permanent-magnet molded bodies produced in this manner have high stability even though they include powder formed from magnetic material having a high affinity for oxygen. It is preferred that the higher coercive force magnet material be employed in the invention. The term "oxygen free" indicates that the plastic and solvent have no combined oxygen and nearly zero entrapped oxygen.

As can be seen, the primary object of the present invention is the provision of a method for using particles of a magnetic material having a high affinity for oxygen with a plastic binder, which method prevents oxidation of the particles during processing or subsequent use.

Another object is the provision of a method as defined above, which method produces a magnet having the advantages of a plastic bonded magnet, regarding shaping and forming, and the advantages of the high energy magnetic materials which have a high affinity for oxygen.

Still another object of the invention is the provision of a magnet produced by the novel method.

The invention has the following features:

(a) before mixing the plastic material with the permanent magnet material particles, dissolving the plastic material in a solvent which does not contain oxygen.

(b) stirring the mixture of particles with the plastic solution and then magnetizing the mixture.

(c) producing a granulated material by evaporating the solvent from the solution of plastic after it is mixed with the magnet material. The evaporization is under a condition excluding air. The agitation of the mixture of particles and plastic allows the solvent to be sucked from the mixture.

EXAMPLE 100 grams of a sintered or cast anisotropic cobalt-samarium alloy are pulverized to such a degree that grain-sizes of about 0.5 mm and less are obtained. If necessary a shielding atmosphere of argon is used.

Furthermore, about 8–18 grams of polystyrene (Polystyrol) are dissolved in benzene (Benzol) in such a way, that a varnish like solution with low viscosity is obtained. With the aid of a shielding gas a paste is formed by mixing the varnish like solution and the cobalt-rare-earth magnet powder. A premagnetization of the paste is effected in a magnetic field. The benzene is then evaporated, and, with a surrounding shielding gas, the hardened mixture is transformed into a granulated condition that can be injection molded. The injection moldable granulated material is then filled into the transfer chamber of an injection molding machine, which chamber has a temperature of 170°–270° C. This melts the plastic into an injection molding condition. With the help of a transfer plunger and under the influence of a magnetic aligning field the heated mixture is then injected into a mold cavity that has a temperature of about 80° C. After the opening of the mold the injected magnet is removed and is then magnetized.

Having thus defined the invention, it is claimed:

1. In a plastic bonded permanent magnet including particles of a cobalt-rare earth alloy permanent magnet material dispersed within a plastic binder, the improvement comprising: said binder being a substantially oxygen free plastic.

2. The improvement as defined in claim 1 wherein said plastic is polystyrene.

3. A method of making a plastic bonded permanent magnet, said method comprising the steps of:

(a) providing particles of cobalt-rare earth alloy permanent magnet material;

(b) providing a magnet binder material of substantially oxygen free plastic;

(c) mixing with said plastic a substantially oxygen free solvent for said plastic until said plastic and solvent form a solution;

(d) then mixing said particles and said solution to provide a mixture; and , (e) then causing said solvent to be evaporated from said plastic binder in said mixture.

4. A method as defined in claim 3 wherein said mixing of said particles and said solution is by stirring said twocomponents.

5. A method as defined in claim 3 wherein said mixing of said particles and said solution is in a substantially oxygen free atmosphere.

6. A method as defined in claim 3 wherein said evaporated solvent is sucked from around said mixture of said particles and said solution.

7. A method as defined in claim 3 wherein the ratio of plastic material to magnetic powder is such that said mixture crumbles into granules.

8. A method as defined in claim 3 including the additional steps of:

(f) forming a magnet from said mixture; and, (g) compressing said magnet to reduce the amount of said plastic in said mixture.

9. A method as defined in claim 3 wherein said particles are anisotropic and including the additional step of:

(f) magnetizing said mixture before said evaporation.

* * * * *